United States Patent [19]

Fleck

[11] 4,185,316

[45] Jan. 22, 1980

[54] APPARATUS FOR THE GENERATION OF IONS

[76] Inventor: Carl M. Fleck, Schelleingasse 14/2, A 1040 Vienna, Austria

[21] Appl. No.: 884,728

[22] Filed: Mar. 9, 1978

[30] Foreign Application Priority Data

| | | | |
|---|---|---|---|
| | [AT] | Austria | 1641/77 |
| Jul. 6, 1977 | [AT] | Austria | 4851/77 |
| Jul. 15, 1977 | [AT] | Austria | 5145/77 |
| Aug. 30, 1977 | [AT] | Austria | 6271/77 |

[51] Int. Cl.[2] ..... H01T 19/00

[52] U.S. Cl. ..... 361/230; 361/231; 55/140; 55/150

[58] Field of Search ..... 361/230, 231, 229, 225; 128/185, 190; 250/324; 55/140, 150

[56] References Cited

U.S. PATENT DOCUMENTS

| | | | |
|---|---|---|---|
| 3,234,432 | 2/1966 | Streib | 361/231 |
| 3,296,491 | 1/1967 | Brown | 361/231 |
| 3,534,530 | 10/1970 | Hornig | 361/231 |
| 3,546,451 | 12/1970 | Jahnke | 361/231 |
| 3,678,337 | 2/1972 | Grauvogel | 361/231 |
| 3,813,548 | 5/1974 | Silverberg | 250/324 |

FOREIGN PATENT DOCUMENTS

| | | | |
|---|---|---|---|
| 2321836 | 11/1974 | Fed. Rep. of Germany | 361/230 |
| 1045883 | 10/1966 | United Kingdom | 128/190 |

*Primary Examiner*—Harry Moose, Jr.
*Attorney, Agent, or Firm*—Kurt Kelman

[57] ABSTRACT

An air ionizer comprises an ion emission wire and a metallic reflecting shield partially surrounding it, the wire and the shield being connected to a high voltage source. The shield is insulated from ground and its two edges define therebetween a discharge region for the emitted ions. The reflecting polarity of the wire and reflecting shield potentials are the same. The high voltage potential at the shield is at least 3000 V, preferably 5000–10,000 V and does not exceed that at the wire. The potential of the high voltage source to which the shield is connected is at least equal to the potential prevailing at the shield edges due to the electrical field generated by the electrical charge at the wire in the absence of a reflecting shield.

14 Claims, 3 Drawing Figures

Figure 1:
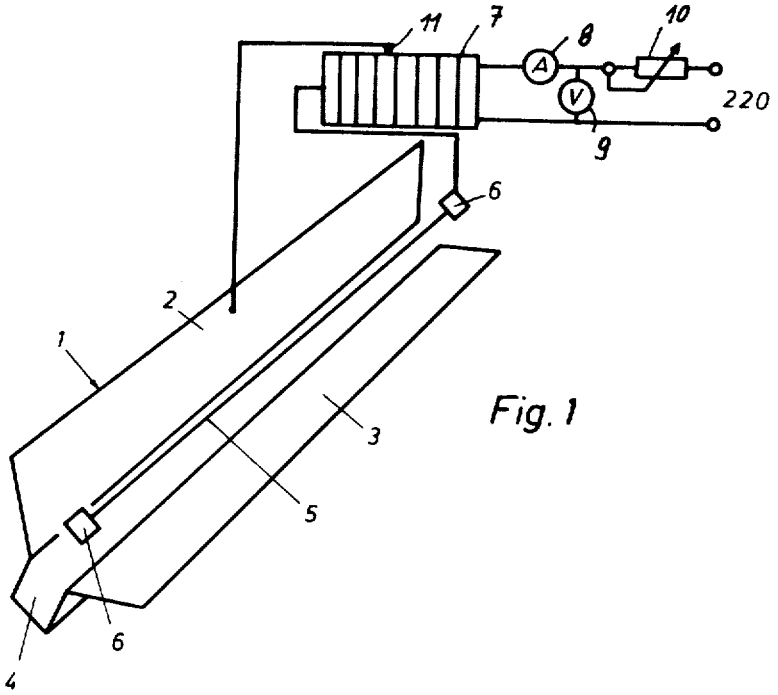

-U(6kV)
470M
23
-6,2kV
25
21
25
22
5'
5
r
r1
r2
22
-6,3kV
470M
24
1

|U|
|U0|
|Us|
ΔU1
ΔU
ΔU2
U1
U
U2
e
r1
r
r2
r

APPARATUS FOR THE GENERATION OF IONS

The invention relates to an apparatus for producing ions, particularly to the ionization of air, with a wire of an electrically conductive material connected to a high voltage source and a reflecting shield, which is at a high voltage potential, arranged at a distance from the wire and partially surrounding the wire, the high voltage potential at the reflecting shield having the same polarity as the high voltage potential of the wire and being between ground potential and the high voltage potential of the wire.

In these known ionizers, electrons are emitted from the surface of the wire by field emission, which are deposited on gas molecules and dust particles. The electrons or ions emitted in all directions from the wire in a short time charge the support surface or holding devices in the immediate neighborhood of the ionizer. Since the high electrostatic potential produced by this undesired charge substantially reduces the drop in voltage around the emission wire which is important for an emission, a substantial reduction in the emission of electrons or ions results.

To obviate this disadvantage, U.S. Pat. No. 3,234,432 has proposed a reflecting shield which surrounds the wire at one side and which has a resistance of 1–1000 megohms connected at one terminal. A drop of voltage is produced at the resistance by a portion of the electrons (ions) radiated against the reflecting shield to bring the reflecting shield to a potential required for repelling the remaining electrons, that is, the high voltage potential at the reflecting shield has the same polarity as the high voltage potential of the wire in this known apparatus and lies between the ground potential and the high voltage potential of the wire. This known apparatus, however, is only conditionally functionally effective in practical operation because a large stream of electrons (ions) must flow to the reflecting shield, on the one hand, to obtain a useful drop in voltage and, on the other hand, an extremely thin wire and a shield at a large distance are required.

An apparatus for producing charge aerosols is known from U.S. Pat. No. 3,296,491 in which a liquid is applied to a wire in the longitudinal direction, which is dispersed and thereby atomized by a plate- or screen-mesh-shaped electrode at a potential differing from that of the wire. Only charged liquid droplets can be produced with this apparatus because in this known apparatus one of the electrodes (wire or plate/screen-mesh) is always grounded. A production of gas ions is not possible with this known apparatus since gas ions would immediately move towards the counter-electrode because of their small mass there to be discharged.

It is the object of the invention to obviate the disadvantages of the known apparatus. This is accomplished in an apparatus of the first-described type in accordance with the invention in that the reflecting shield, for instance by insertion in an insulating synthetic resin housing, is insulated from ground and is connected to a high voltage source, a potential of at least 3000 V, but preferably one of 5000–10,000 V, being applied to the reflecting shield from the high voltage source.

Reflecting shields of relatively small dimensions may be used in the apparatus according to the invention without losing the effectiveness of the reflecting shield. Therefore, the apparatus of the invention may be constructed without difficulties as a handy table model.

High voltage sources of very small power may be used. A contact with the wire as well as the reflecting shield is absolutely harmless since the voltage breaks down immediately upon contact. Usually, current limit resistors are provided between the wire as well as the reflecting shield and the high voltage source. The output of emission of the wire may be controlled and stabilized. This is relatively simple by bringing the shield to a more negative (more positive) potential than that of the free potential V(r) about an indistrubed wire according to the equation $$V(r) = V_o \frac{\ln \frac{r}{r_i}}{In \frac{r_a}{r_i}}$$

wherein $r_i$ is the diameter of the wire, $r_a$ is the median corrected distance to the environment of the wire and $V_o$ is the potential of the wire. The reflecting capacity of the shield may be increased in a simple manner by somewhat increasing the potential of the shield. A preferred embodiment of the invention, therefore, provides that the reflecting shield is connected to a potential which is at least equal to, but is preferably greater than the potential which is prevalent at the location of the edges of the discharge region due to the electrical field produced by the electrical charge on the emission wire when the emission wire is mounted without a metallic shield.

A further advantageous embodiment of the invention consists in that the high voltage potential of the wire is adjustable together with the high voltage potential of the reflecting shield. The potential usually is 5000 V above that of the reflecting shield, that is, the potential at the wire is preferably 10,000 to 15,000 V.

It is known that not only air ions but electrical fields with low-frequency modulation also have a positive effect on human beings. It has already been confirmed that an electrical field with a 10 Hz frequency modulation has caused better learning success and increased attention at tests with students of a class.

It is also an object of the invention to construct the ionizers of the first-described type so that they produce not only air ions but also an alternating field without requiring complicated apparatus. The invention attains this object by connecting a high voltage potential pulsating between an upper and a lower value with a frequency of 1 to 20 Hz, preferably 3–12 Hz, to the reflecting shield.

Wire ionizers have the disadvantage that the emission wire, which extends freely tensioned between two holders, cannot be protected against mechanical access and, due to its small diameter (mostly below 50μ), tears easily when subjected to outside mechanical effects.

It is a further object of the invention to obviate this disadvantage and to apply such a tension force to the wire that the wire is released when it is mechanically touched.

For this purpose, the first-described apparatus is so constructed according to the invention that a magnetic field may be applied to the magnetic or magnetizable mount of the wire, the magnetic attracting force being smaller than the tensile strength of the wire.

Figure 2:
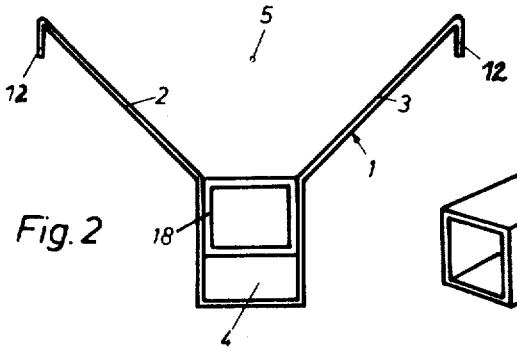
Figure 3:
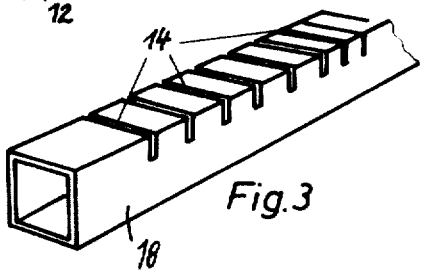
Figure 4:
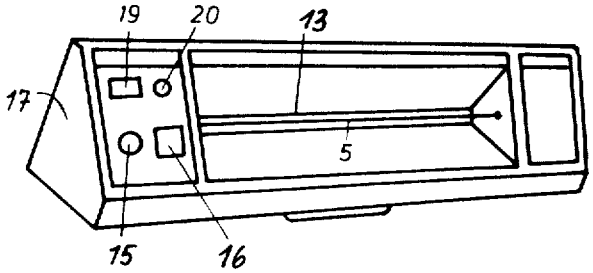
Figure 5:
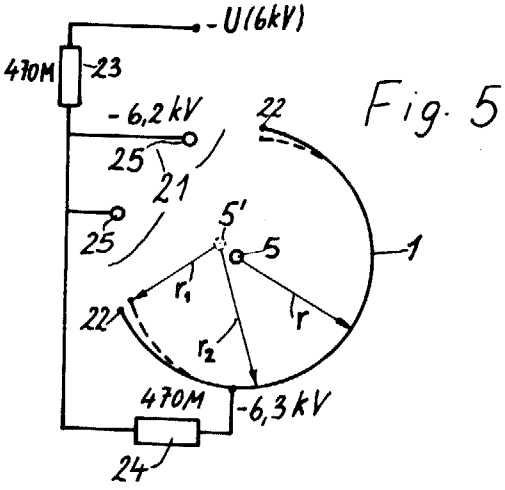
Figure 6:
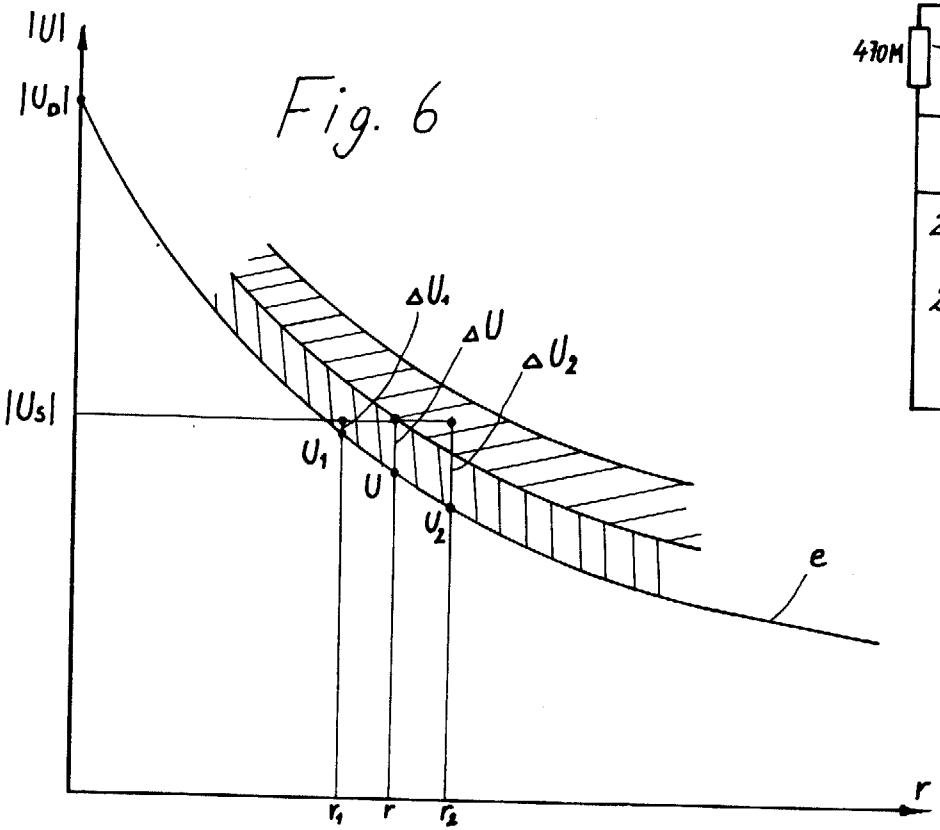
Figure 7:
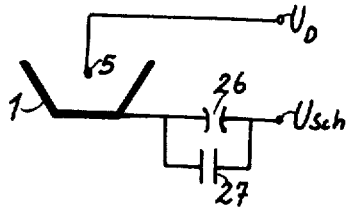
Figure 8:
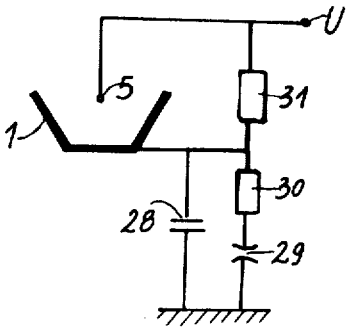
Figure 9:
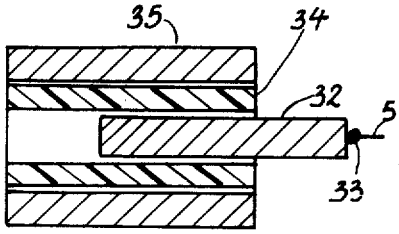
Figure 10:
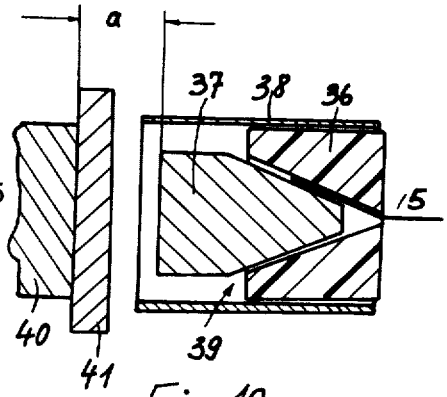
Figure 11:
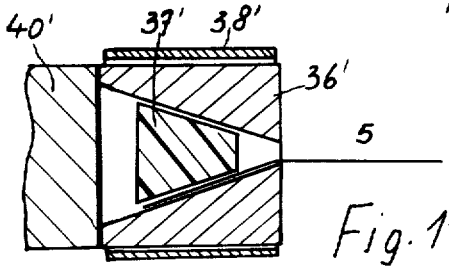

The invention will now be described in detail with reference to the drawings. In the drawings shown FIG. 1 an embodiment of an apparatus according to the invention for producing ions, in a schematic illustration;

FIG. 2 a section through another embodiment of an apparatus according to the invention;

FIG. 3 a perspective view of a portion of a guide tube for an apparatus according to the invention;

FIG. 4 an embodiment of the apparatus of the invention constructed as a table model;

FIG. 5 a schematic illustration of another embodiment of the apparatus of the invention with a reflecting shield of cylindrical transverse section;

FIG. 6 a diagram with the voltage distribution about the wire in an apparatus according to FIG. 5;

FIGS. 7 and 8 two embodiments of circuits for producing a frequency-modulated potential on the reflecting shield and FIGS. 9, 10 and 11 three embodiments of mounts for the wire of an apparatus according to the invention.

FIG. 1 schematically shows an apparatus according to the invention for the production of ions. The apparatus has a reflecting shield 1, which may consist of aluminum, with two outwardly converging plates 2, 3 and a channel 4 of U-shaped cross section connected to the two plates 2, 3. A wire 5 is tensioned between two mounts 6 in longitudinal direction of shield 1. The mounts 6 are affixed (not shown) to the side portions of the housing. The wire 5 as well as the shield 1 are separately connected to a high voltage potential of the same polarity. For this purpose, a high voltage circuit 7 is provided for wire 5 and shield 1. The high voltage circuit 7 may be of known construction which generates a direct current voltage up to 20 kV from the network alternating current of 220 V. The high voltage circuit 7 is connected by an adjustable resistance 10 to an alternating current source, for example the network voltage. A voltmeter 9 and an ammeter 8 are provided to measure the voltage and the current. In FIG. 1, only a positive or only a negative high voltage potential is applied to wire 5 and shield 1, depending on whether it is desired to produce positive or negative ions. The voltage on shield 1 may be adjusted by adjusting tap 11 at the high voltage circuit 7, that is the voltage on wire 5 and on shield 1 may be adapted to the prevailing conditions. Wire 5 has a diameter of 50$\mu$ or less and preferably consists of tungsten or tantalum. Wire 5 may be surface-treated with cesium or barium and/or the wire may be alloyed with thorium to increase the emission efficiency of the wire. The electron emission of wire 5 may be further enhanced by reducing the diameter of wire 5, by increasing the length of wire 5 and by increasing the high voltage potential applied to the wire (adjustment of potentiometer 10). The emission strength of wire 5 and the corresponding amount of produced ions may be read from ammeter 9. A high voltage potential of at least 3 kV, but preferably between 5 and 10 kV, is applied to shield 1. When the apparatus according to the invention is switched on, a continuous production of ions around wire 5 is developed, the ions being deflected from shield 1 and being moved into the free space.

In the embodiment of FIG. 2, shield 1 has two webs 12 projecting from the upper edge of plates 2, 3, which serve for affixing the shield to the walls (not shown) of a synthetic resin housing. A guide tube 18 of synthetic resin (FIG. 3) is mounted in channel 4, which has several outwardly directed outlet slits 14. A blower and/or an aerosol preparation device (not shown) may be connected to guide tube 18 so that a continuous stream of ionized air or an electroaerosol stream emerging into the room may be obtained. Fluorescent tubes (not shown) may also be mounted in channel 4 so that a light combined with an ionizer may be obtained.

A table model with a synthetic resin housing 17 is illustrated in FIG. 4, which is combined with a light 13. Designated with 19 is a voltmeter, with 20 a safety indicator, with 15 a control for adjusting the voltage of wire 5 and with 16 a switch for turning fluorescent tube 13 off and on.

The apparatus of the invention may be used for the production of negative as well as positive ions. For this purpose, the high voltage on the emission wire is changed in polarity by a pulse generator in an adjustable rhythm or two devices according to the invention may be combined into a unit, the voltages at the wires having different polarities.

In FIG. 5, the emission wire is again designated 5 and a cylindrical reflecting shield 1. Reflecting shield 1 has a discharge region 21 extending parallel to the axis of emission wire 5, which is delimited by edges 22 and has an opening angle of preferably 60–160°. In the diagram according to FIG. 6, the course of the potential about the unencumbered emission wire 5, that is in the absence of shield 1, is illustrated by the curve, distance r from emission wire 5 being shown along the abscissa and absolute potential U being shown along the ordinate. At the distance r from emission wire 5, there prevails a potential $U_r$ in the absence of a shield 1. According to the invention, a potential at least equal to potential $U_r$ is applied to the cylindrical metal shield. In FIG. 5, a potential $U_s$ has been applied to shield 1. Therefore, shield 1 has a potential exceeding potential $U_R$ by the amount $\Delta U$.

The voltage at edges 22 of shield 1 is primarily responsible for the discharge of air ions from discharge region 21 (FIG. 5), at which location the same potential prevails as on the other portion of the shield with an imagined cylindrical shield 1 and an arrangement of emission wire 5 in the cylinder axis if the field is not disturbed. According to the invention, emission wire 5 may either be displaced out of the cylinder axis into position 5' or edges 22 may be bent inwardly closer to wire 5 (see broken lines in FIG. 5). Since shield 1 is of metal, the voltage $U_2$ is always applied to the entire shield 1. This means that edges 22 (distance $r_2$) are above that potential ($U_2$ or $U_1$), which would prevail at the respective locations of the fictitious shield with an undisturbed field, by the potential difference $\Delta U_2$ and the center region (distance $r_1$) of shield 1 by the potential difference $\Delta U_1$. Since the potential difference $\Delta U_2$ is larger than the potential difference $\Delta U_1$, a useless current flow between shield 1 and emission wire 5 is thus prevented and a good emission efficiency is obtained.

In the embodiment of FIG. 5, shield 1 is connected to a high voltage potential $-U$ via two series-connected high ohm resistances 23, 24 and the potential is so adjusted that it corresponds to the undisturbed potential about wire 5 at the location of shield 1. At the inception of ion emission, a large part of the ions will in the beginning leak from shield cylinder 1. This produces a voltage drop at the high ohm resistances 23, 24, which reduces the field strength between wire 5 and shield 1 and displaces the potential of shield 1 in the direction of the wire potential, and thus projects more ions through the discharge region 21. The case that emission ceases completely cannot occur since, in this case, no voltage drop would occur at the high ohm resistances 23, 24.

In FIG. 5, parts of the shield are constituted by rods 25 which are connected to the high voltage source −U only by high ohm resistance 23. The encompassing part 1 of the shield thus has a higher potential than rods 25 so that ion flow to part 1 is suppressed. With a voltage of the source −U of −6 KV and a wire voltage of −10 KV, part 2 has an approximate voltage of −6.3 KV and rods 23 have a voltage of −6.2 KV.

Shield 1 may be a screen-mesh or it may be a solid cylinder wherein slits defining discharge region 21 are provided.

In the embodiment according to FIG. 7, reflecting shield 1 is connected to a high voltage potential $U_{Sch}$ by a spark gap 26. A condenser 27 is connected in parallel to spark gap 26. Wire 5 is connected to a high voltage potential $U_D$. In the circuit of FIG. 8, reflecting shield 1 is grounded via a parallel circuit of a condenser 28 and a spark gap 29. A resistance 30 is connected in series with spark gap 29. Shield 1 is connected via resistance 31 to high voltage potential U to which wire 5 is also connected. Due to the charging of shield 1 by the ion stream and a suitable selection of the sparking and cut-off potential of spark gaps 26 and 29 and capacity 27 and 28 and resistance 30, a high voltage potential is produced at shield 1 which pulsates between an upper (about 7 kV) and a lower (about 5 kV) pulsating high voltage potential, with a frequency of 1-20 Hz, preferably 3-12 Hz.

Three embodiments for tensioning and holding an end of emission wire 5 are shown in FIGS. 9, 10, and 11.

In the embodiment of FIG. 9, a permanent bar magnet 32 is guided in a guide sleeve 34 of non-magnetic material, preferably "Teflon". The guide sleeve is surrounded by a metallic sleeve 35. A ball 33 is provided at the one end of wire 5, which is held by the bar magnet. If the wire 5 is subjected to a load which exceeds the attracting force of ball 33 to bar magnet 32, the ball 33 is removed from bar magnet 32. The attracting force of bar magnet 32 may be fixed in a simple manner by a suitable selection of the thickness of guide sleeve 34, the attracting or tensile force exerted by bar magnet 32 on ball 33 being fixed to be smaller than the tensile strength of wire 5. In this manner, tearing of the wire will not ensue when the tensioned wire 5 is unintentionally touched.

In the embodiment according to FIGS. 10 and 11, the end of wire 5 is clamped between a conical sleeve 36 and a conical body 37. The mount 39 formed by the conical sleeve 36 and conical body 37 is movable in a guide sleeve 38 against a permanent magnet 40. A synthetic resin platelet 41 is mounted in the embodiment of FIG. 10 between mount 39 and permanent magnet 40. The attracting force or biasing force of magnet 40 on mount 39 may be adjusted by suitable selection of the thickness of platelet 41. One of the two parts 36 or 37 must consist of magnetizable material, for instance a suitable metal, the supply of current to wire 5 being then effected through this part.

In the embodiment of FIG. 10, a metallic conical body 37 is clamped in a conical sleeve 36. In the embodiment of FIG. 11, on the other hand, conical body 37' is of synthetic resin and sleeve 36' of metal. To obtain a suitable tensioning of wire 5, mount 39 is arranged at a distance a from the magnet (FIG. 10) at least at one end of wire 5. At the other end, however, mount 39' may directly touch magnet 40'. Herein, the current supply to wire 5 may be effected directly through magnet 40' and sleeve 36'.

I claim:

1. An apparatus for generating ions, comprising (a) high voltage source means, (b) a wire of electrically conductive material connected to the high voltage source means for applying a high voltage potential to the wire whereby ions are emitted therefrom, (c) a metallic reflecting shield arranged at a distance from the wire and having two edges wherebetween the shield partially surrounds the wire, the shield edges defining therebetween a discharge region for the emitted ions, and the reflecting shield being connected to the high voltage source means for applying to the shield a high voltage potential of the same polarity as that of the high voltage potential applied to the wire, the high voltage potential at the reflecting shield being at least 3000 V and not exceeding the high voltage potential at the wire, and the potential of the high voltage source means to which the shield is connected being at least equal to the potential prevailing at the shield edges due to the electrical field generated by the electrical charge at the wire in the absence of a reflecting shield, and (d) means for insulating the reflecting shield from ground.

2. The ion generating apparatus of claim 1, wherein the high voltage potential at the reflecting shield is between 5000 and 10,000 V.

3. The ion generating apparatus of claim 1, wherein the potential of the high voltage source means to which the shield is connected is higher than that prevailing at the shield edges.

4. The ion generating apparatus of claim 1, wherein the shield edges are arranged closer to the wire than the reflecting shield therebetween partially surrounding the wire.

5. The ion generating apparatus of claim 4, wherein the shield is constituted by a portion of a generally cylindrical wall partially surrounding the wire, the wire forming the axis of the cylindrical wall and the edges thereof defining the discharge region being closer to the axis then the cylindrical wall portion.

6. The ion generating apparatus of claim 1, wherein the reflecting shield is at least partially a perforated screen.

7. The ion generating apparatus of claim 1, further comprising means for jointly adjusting the high voltage potential of the wire and the shield.

8. The ion generating apparatus of claim 1, wherein the means for insulating the reflecting shield from ground comprises a synthetic resin housing wherein the shield is mounted.

9. The ion generating apparatus of claim 1, wherein the potential of the high voltage source means to which the shield is connected is a potential pulsating between an upper and lower value with a frequency of 1 to 20 Hz, and further comprising a spark gap and a condenser connected in parallel between the high voltage source means and the reflecting shield.

10. The ion generating apparatus of claim 1, wherein the potential of the high voltage source means to which the shield is connected is a potential pulsating between an upper and lower value with a frequency of 1 to 20 Hz, and further comprising a spark gap and a condenser connected in parallel between the ground and reflecting shield.

11. The ion generating apparatus of claim 1, further comprising means for tensioning the wire, the tensioning means including a magnet exerting an attracting force upon at least one end of the wire.

12. The ion generating apparatus of claim 11, wherein the attracting force of the magnet is smaller than the tensile strength of the wire.

13. The ion generating apparatus of claim 11, wherein the end of the wire upon which the magnet exerts the attracting force has a substantially spherical enlargement for magnetic attachment to the magnet, the magnet being a permanent magnet.

14. The ion generating apparatus of claim 11, wherein the tensioning means further includes a conical sleeve member and a conical body member fitting thereinto, the end of the wire upon which the magnet exerts the attracting force being clamped between said members, and one of said members being of magnetizable material.

* * * * *